US011064284B2

(12) United States Patent
Rugolo et al.

(10) Patent No.: US 11,064,284 B2
(45) Date of Patent: Jul. 13, 2021

(54) TRANSPARENT SOUND DEVICE

(71) Applicant: X Development LLC, Mountain View, CA (US)

(72) Inventors: Jason Rugolo, Mountain View, CA (US); Bin Ni, Fremont, CA (US); Cyrus Behroozi, Menlo Park, CA (US)

(73) Assignee: X Development LLC, Mountain View, CA (US)

( * ) Notice: Subject to any disclaimer, the term of this patent is extended or adjusted under 35 U.S.C. 154(b) by 0 days.

(21) Appl. No.: 16/235,360

(22) Filed: Dec. 28, 2018

(65) Prior Publication Data

US 2020/0213711 A1 Jul. 2, 2020

(51) Int. Cl.
*H04R 1/10* (2006.01)
*G10K 11/178* (2006.01)
(Continued)

(52) U.S. Cl.
CPC ..... *H04R 1/1091* (2013.01); *G10K 11/178* (2013.01); *H04R 1/1083* (2013.01);
(Continued)

(58) Field of Classification Search
CPC .. H04R 1/1091; H04R 1/1041; H04R 1/1016; H04R 3/005; H04R 5/033; H04R 2201/107; H04R 2201/109; H04R 2400/01; H04R 2420/07; H04R 2499/11; H04R 29/00; H04R 29/001; H04R 29/002;
(Continued)

(56) References Cited

U.S. PATENT DOCUMENTS 6,996,244 B1 2/2006 Slaney et al.
9,640,194 B1 5/2017 Nemala et al.
(Continued)

FOREIGN PATENT DOCUMENTS

EP 3 188 500 B1 8/2018

OTHER PUBLICATIONS

U.S. Appl. No. 16/234,999, Tympanic Membrane Measurement, filed Dec. 28, 2018, 31 pages.
(Continued)

*Primary Examiner* — Leshui Zhang
(74) *Attorney, Agent, or Firm* — Christensen O'Connor Johnson Kindness PLLC

(57) ABSTRACT

An in-ear device includes a housing shaped to hold the in-ear device in an ear of a user, and an audio package, disposed in the housing, to emit augmented sound. A first set of one or more microphones is positioned to receive external sound, and a controller is coupled to the audio package and the first set of one or more microphones. The controller includes a low-latency audio processing path, digital control parameters, and logic that when executed by the controller causes the in-ear device to perform operations. The operations may include receiving the external sound with the first set of one or more microphones to generate a low-latency sound signal; augmenting the low-latency sound signal by passing the low-latency sound signal through the low-latency audio processing path to produce an augmented sound signal; and outputting, with the audio package, the augmented sound based on the augmented sound signal.

14 Claims, 6 Drawing Sheets

(51) Int. Cl.
*H04R 3/00* (2006.01)
*H04S 7/00* (2006.01)
*H04R 5/033* (2006.01)

(52) U.S. Cl.
CPC ..... *H04R 3/005* (2013.01); *G10K 2210/1081* (2013.01); *H04R 2201/107* (2013.01)

(58) Field of Classification Search
CPC .. H04R 29/003; H04R 29/004; H04R 29/005; H04R 29/006; H04R 29/007; H04R 25/30; H04R 25/305; H04R 25/70; H04R 3/04–10; H04R 3/06; H04R 3/14; H04R 2201/103; H04R 2201/10; H04R 1/1008–1083; H04R 3/00; H04R 3/02; H04R 5/0335; G10L 21/0208; G10L 2021/02087; H04M 1/6041; H04M 1/6058; H04M 1/6066; H04M 1/05; H04M 2250/02; H04B 1/385; H04B 1/05; H04B 1/6058; H04B 1/6066; G10K 11/172; G10K 11/175; G10K 11/178; G10K 11/1781; G10K 11/17813; G10K 11/17825; G10K 11/17815; G10K 11/17817; G10K 11/17819; G10K 11/17821; G10K 11/17823; G10K 11/17827; G10K 11/1783; G10K 11/17837; G10K 11/1785; G10K 2210/1081; G10K 2210/108; G10K 2210/1082; G10K 2210/10; G10K 2210/109; G10K 2210/107; G10K 11/17881; G10K 11/17883; G06F 3/16; G06F 3/162; G06F 3/165; G06F 3/167; G06F 16/60; G06F 16/61; G06F 16/632; G06F 16/634; G06F 16/635; G06F 16/636; G06F 16/637; G06F 16/638; G06F 16/639; G06F 16/64; H04S 7/30; H04S 7/301; H04S 2420/01
USPC ..... 381/26, 74, 73.1, 309, 312–322, 328, 381/122, 123, 71.1–71.14; 455/569.1, 455/569.2, 570, 575.2
See application file for complete search history.

(56) References Cited

U.S. PATENT DOCUMENTS

2006/0067548 A1* 3/2006 Slaney ..... H04S 1/002 381/303
2009/0136052 A1* 5/2009 Hohlfeld ..... G10K 11/17873 381/71.1
2010/0017006 A1 1/2010 Clausen et al.
2010/0183172 A1* 7/2010 Roeck ..... H04R 25/453 381/150
2012/0201405 A1 8/2012 Slamka et al.
2014/0016804 A1* 1/2014 Burns ..... H04R 25/658 381/312
2014/0119553 A1* 5/2014 Usher ..... G01H 3/00 381/72
2016/0183014 A1* 6/2016 Guo ..... G10L 25/78 381/23.1
2017/0148428 A1 5/2017 Thuy et al.
2017/0311068 A1 10/2017 Shin
2018/0197527 A1* 7/2018 Guiu ..... G10K 11/17881

OTHER PUBLICATIONS

U.S. Appl. No. 16/235,417, Open-Canal In-Ear Device, filed Dec. 28, 2018, 23 pages.
U.S. Appl. No. 16/235,092, Optical Otoscope Device, filed Dec. 28, 2018, 27 pages.
U.S. Appl. No. 16/176,660, Modular In-Ear Device, filed Oct. 31, 2018, 30 pages.
International Search Report and Written Opinion, dated Mar. 12, 2020, for International Patent Application No. PCT/US2019/062399, 11 pages.

* cited by examiner

TRANSPARENT SOUND DEVICE

TECHNICAL FIELD

This disclosure relates generally to audio devices.

BACKGROUND INFORMATION

Headphones are a pair of loudspeakers worn on or around a user's ears. Circumaural headphones use a band on the top of the user's head to hold the speakers in place over or in the user's ears. Another type of headphones are known as earbuds or earpieces and include individual monolithic units that plug into the user's ear canal.

Both headphones and ear buds are becoming more common with increased use of personal electronic devices. For example, people use head phones to connect to their phones to play music, listen to podcasts, etc. However, headphone devices are currently not designed for all-day wear since their presence blocks outside noise from entering the ear. Thus, the user is required to remove the devices to hear conversations, safely cross streets, etc.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Figure 1:
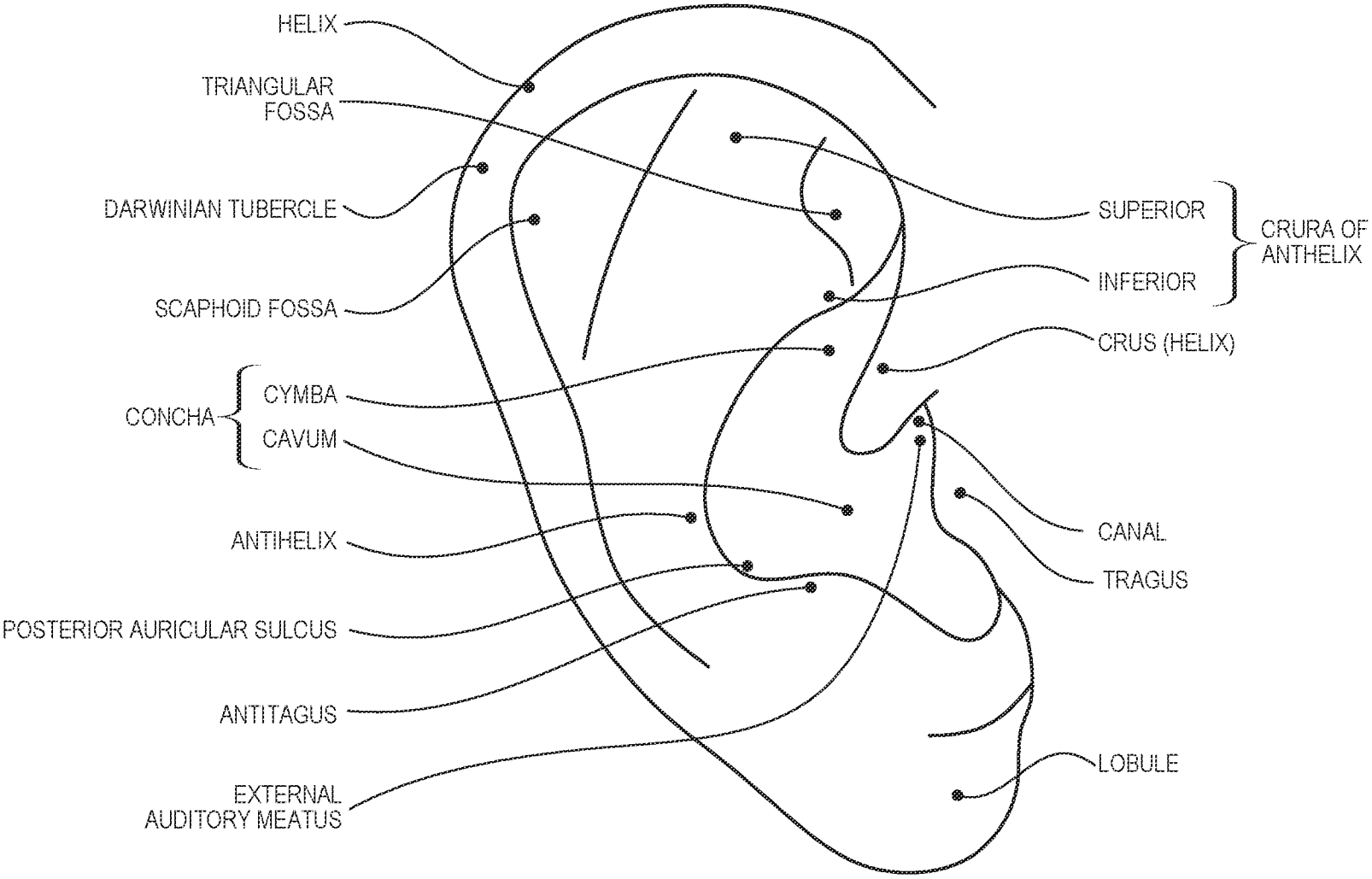
FIG. 1 is a cartoon illustration of a human ear.

Embodiments of a system, apparatus, and method for a transparent sound device are described herein. In the following description, numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Generally, ear-worn monitors are useful for displaying sounds to the human ear while on the go. Music, directions, digital assistants, and ambient sound modification are all things people want. Accordingly, it is desirable to be able to wear headphones all day in order to achieve a continuous enhanced audio experience. However, noise canceling and ear occluding devices need to be removed to accurately hear the surrounding world. Put another way, these devices do not allow for sound transparency, thus requiring individuals to constantly move their ear phones on and off of their ears. Taking earphones on and off is inconvenient and frequently results in the user losing/misplacing the devices. Accordingly, active sound modification to achieve "sound transparency" is beneficial so the user does not need to remove the device from their ears.

However, one reason why active sound augmentation is difficult to achieve is that the head-related transfer function (HRTF)—a function that characterizes how an individual's ear receives a sound, which takes into consideration many variables such as the size and shape of the head, ears, ear canal, density of the head, size and shape of nasal and oral cavities—is difficult to measure, and is different for each person. Accordingly, a one-size-fits-all approach to active sound modification devices may not work well.

Here we present an apparatus, system, and methods for devices to perform highly accurate sound augmentation. Devices described in examples in accordance with the teaching of the present disclosure, may include N microphones to receive external sounds (including both sounds received from the user—chewing, sneezing, breathing, etc.—and sounds from outside the user—car horns, engine noise, etc.). The device may also have an application specific integrated circuit (ASIC) with a low-latency (e.g, analog) audio processing path and a digital control path to adjust how low-latency signals are processed (e.g., digitally changing filter parameters, but filters are applied to analog signals). Then, the processed audio is output from a speaker in or near the user's ear. It is appreciated that in some embodiments, by keeping the audio signals in the analog domain, processing time is kept to a minimum—an important metric in real-time audio processing. In order to account for each individual's unique HRTF, the digital control parameters are created and personalized using an algorithm (e.g., a machine learning algorithm like a neural network) that uses ground-truth information collected from many users to output the digital control parameters.

The following disclosure will describe the embodiments discussed above, and other embodiments, as they relate to the figures.

FIG. 1 is a cartoon illustration of human ear anatomy. The anatomy depicted may be referenced in connection with how the in-ear device (see, e.g., FIG. 2A) fits inside the ear. Shown are the location of the helix, triangular fossa, Darwinian tubercle, scaphoid fossa, concha (including the cymba and cavum), antihelix, posterior auricular sulcus, antitragus, external auditory meatus, crura of antihelix (both superior and inferior), crus, anterior notch, supratragal tubercle, canal, tragus, intertragal notch, and lobule.

Figure 2A:
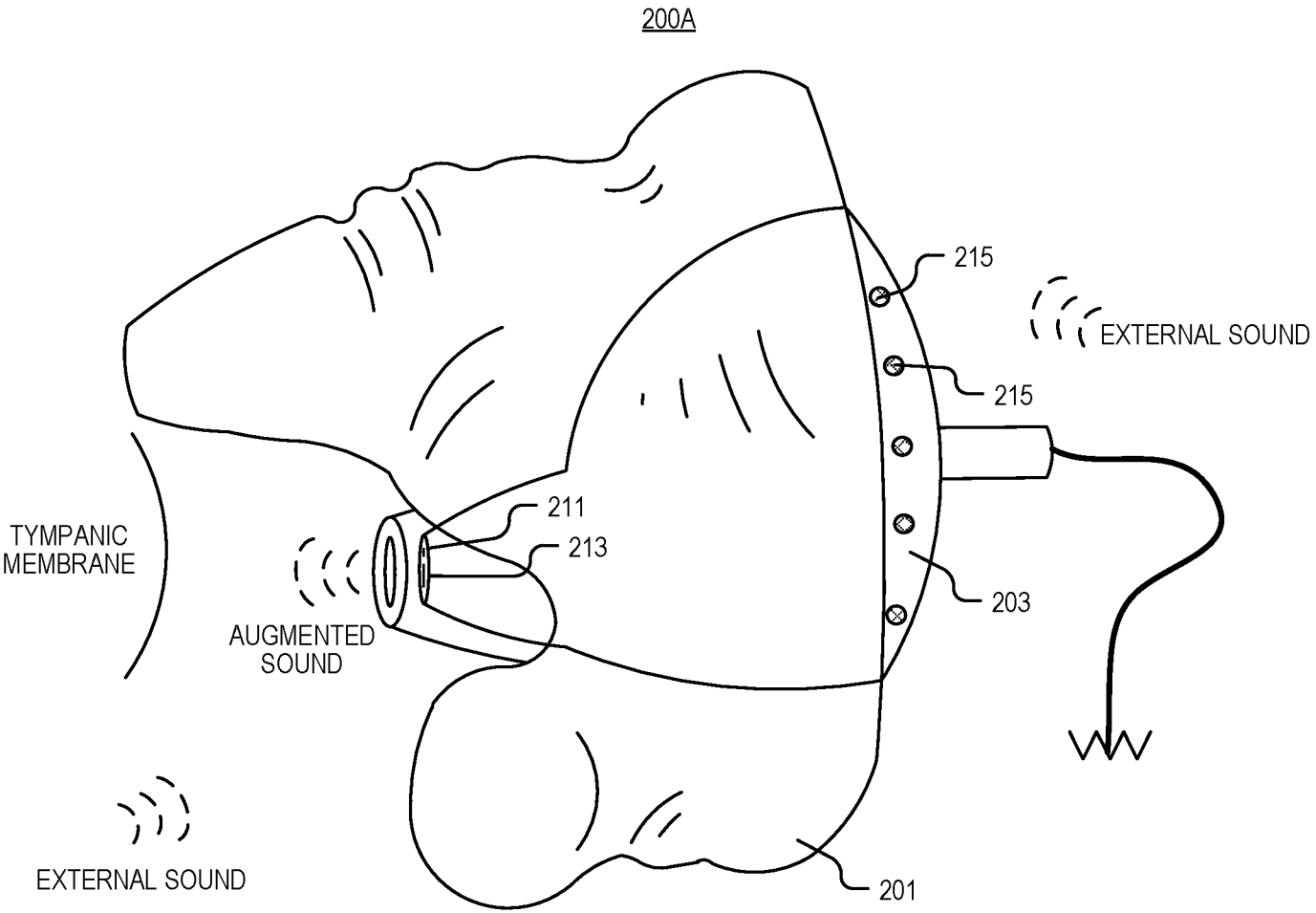
FIG. 2A illustrates an audio device, in accordance with an embodiment of the disclosure.

FIG. 2A illustrates an in-ear device, in accordance with an embodiment of the disclosure. Depicted are housing—including both molding 201 (e.g., a soft polymer, like silicone that may be custom designed to fit in the user's ear for long term use), and casing 203 (e.g., a hard plastic casing to hold electronic devices and friction fit inside a hollowed out portion of molding 201)—first set of one or more microphones 215, second set of one or more microphones 211, and speaker 213 (e.g., a balanced armature driver, coil or the like). It is appreciated that there may be one in-ear device 200A for each ear (e.g., two in-ear devices 200 may be provided as a set).

As shown, the housing shaped to hold in-ear device 200A in an ear of a user (e.g., by friction fitting into portions of the concha) and at least partially occludes the canal. An audio package (see infra FIG. 2B) is disposed in the housing to emit augmented sound, and a first set of one or more microphones 215 is positioned to receive external sound. A controller (disposed in casing 203) is coupled to the audio package and first set of one or more microphones 215. The controller includes both a low-latency audio processing path (e.g., a path for analog signals to pass through and be filtered/augmented) and digital control parameters (e.g., parameters including weights that can be adjusted digitally to bias analog circuitry in the audio processing path), and the controller includes logic that when executed by the controller causes the in-ear device to perform operations. Operations may include receiving the external sounds with first set of one or more microphones 215 to generate a low-latency (e.g., analog or digital) sound signal, and augmenting the low-latency sound signal by passing the low-latency sound signal through the low-latency audio processing path to produce an augmented sound signal. As stated, the digital control parameters include weights (e.g., digital values) to bias low-latency (e.g., analog) circuits (e.g., to control amplification of a signal, or filtering of certain wavelengths) in the low-latency audio processing path. Once the augmented sound signal is generated, it may be used to output an augmented sound from the audio package. In one example, the low-latency audio processing path may include at least one of analog circuitry, a digital signal processor, application specific integrated circuitry, or a field programmable gate array.

As shown, in-ear device 200A may be designed for extended wear (due to the soft polymer molding 201 that is custom made for each individual user). As stated, the housing may at least partially occlude the canal of the ear when it is positioned in the ear. This may cause the user to experience sounds in a manner similar to wearing ear plugs. Accordingly, it is desirable for the device to provide at least partial "sound transparency" to the user. Put another way, the device may receive sounds with the microphones (e.g., microphones 215) and re-emit the sounds to the user—after the sound augmentation process, described above, occurs—so that the user hears the sounds as if there was no device occluding his/her ear canal.

In addition to providing sound transparency, it is appreciated that the device herein may cancel sound, amplify select sounds, translate language, play music/audio, provide virtual assistant services (e.g., the headphones record a question, send the natural language data to the cloud for processing, and receive a natural language answer to the question), or the like. These other processes, where processing time matters less than real-time sound augmentation, may be performed with a general-purpose processor in the controller, or other ASICs in the controller, or sent to the cloud for remote processing. As stated, second set one or more of microphones 211 may be canal microphones (e.g., facing into the ear canal to receive external sound in the ear canal such as speech or other sounds generated by the user). The canal microphones may be used to receive the user's speech (e.g., when in-ear device 200C is used to make a phone call) and transmit the recorded sound data to an external device (e.g., smartphone). Canal microphones may also be used for noise cancelation and sound transparency functionality to detect noises made by the user (e.g., chewing, breathing, or the like) and cancel these noises in the occluded (e.g., by in-ear device 200) ear canal. It is appreciated that user generated noises can seem especially loud in an occluded canal, and accordingly, it may be desirable to use noise cancelation technologies described herein to cancel these sounds.

Figure 2B:
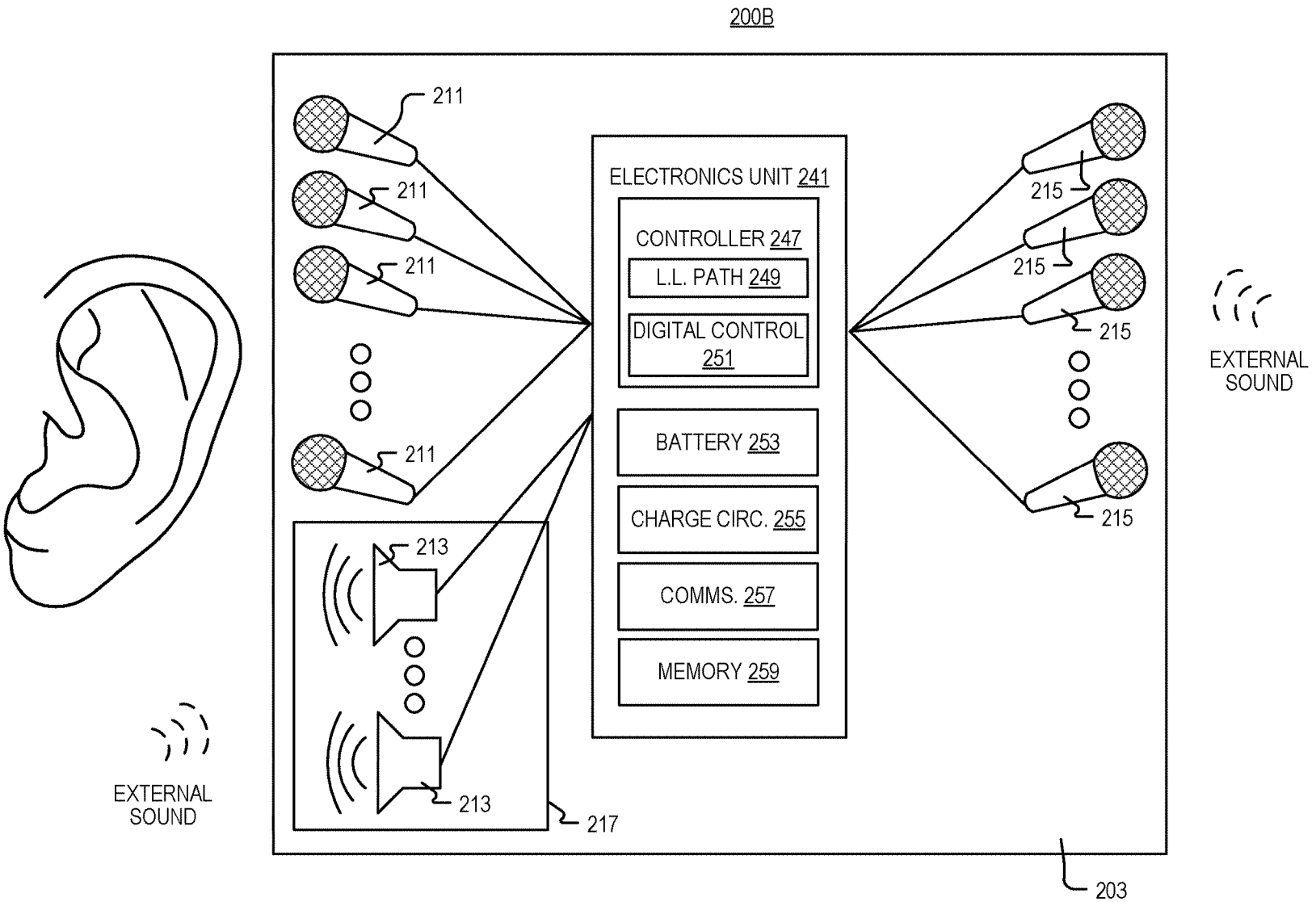
FIG. 2B illustrates a block diagram of the audio device of FIG. 2A, in accordance with an embodiment of the disclosure.

FIG. 2B illustrates a block diagram of the in-ear device of FIG. 2A, in accordance with an embodiment of the disclosure. Illustrated are casing 203, first set of microphones 215 (facing away from the user's ear), second set of microphones 211 (facing into the user's ear), audio package 217 (including one or more speakers 213 such as balanced armature drivers), and electronics unit 241. Electronics unit 241 includes, controller 247 (with low-latency audio processing path 249 and digital control parameters 251), battery 253 (e.g., lithium ion battery, capacitor, or the like), charging circuitry 255 (e.g., direct electrical input such, such as USB 2.0, inductive charging loops, or the like), communication circuitry 257 (e.g., direct electrical input or wireless communication like Bluetooth, RFID, WIFI, or the like), and memory 259 (e.g., RAM, ROM, or a combination thereof, or the like). One of skill in the art having the benefit of the present disclosure will appreciate that all components depicted may be electrically coupled.

The, device 200B depicted may perform all the same functionality as described in connection with device 200A in FIG. 2A. Additionally, in-ear device 200B includes a second set of one or more microphones 211 coupled to controller 247 and positioned to face into the ear of the user, and first set of one or more microphones 215 is positioned to face away from the user. The second set of microphones 211 may record the external sound emanating from inside the user's body (e.g., chewing, breathing, etc.) and be used to generate the low-latency sound signal. Thus, the low-latency sound signal may include noises from within the user's body and noises from outside to the user's body. Accordingly, the sound augmentation techniques described herein may take sound data from both sources of external sound and use that data to produce sound transparency and select noise cancelation. For example, when the ear canal is clogged, external noises generated inside the body may be perceived by the user as very loud. Accordingly, in order to provide an approximation of true sound transparency, these internal sounds may be taken into consideration by the controller.

In the depicted embodiment, the digital control parameters (which may be in a control file) are stored in a memory 259 in the controller 247. As will be described in connection with FIG. 2C, in one embodiment this memory 259 has read/write functionality so that the digital control parameters may be updated by the user, via a software update, or the like.

In the depicted embodiment, the low-latency audio processing path includes mapping a plurality of microphone inputs (e.g., from microphones 211 and 215) to one or more audio outputs (e.g., speakers 213 in audio package 217), and there are more microphone inputs than audio outputs. Accordingly, accurate mapping may be achieved by playing point sounds to individual users and recording the sound that reaches their ear drum. A machine learning algorithm may be used to map the microphone inputs to the speaker outputs to achieve a sound wave that interacts with the ear drum in the same way that the natural sound did. Thus providing mapping that is capable of achieving sound transparency.

Figure 2C:
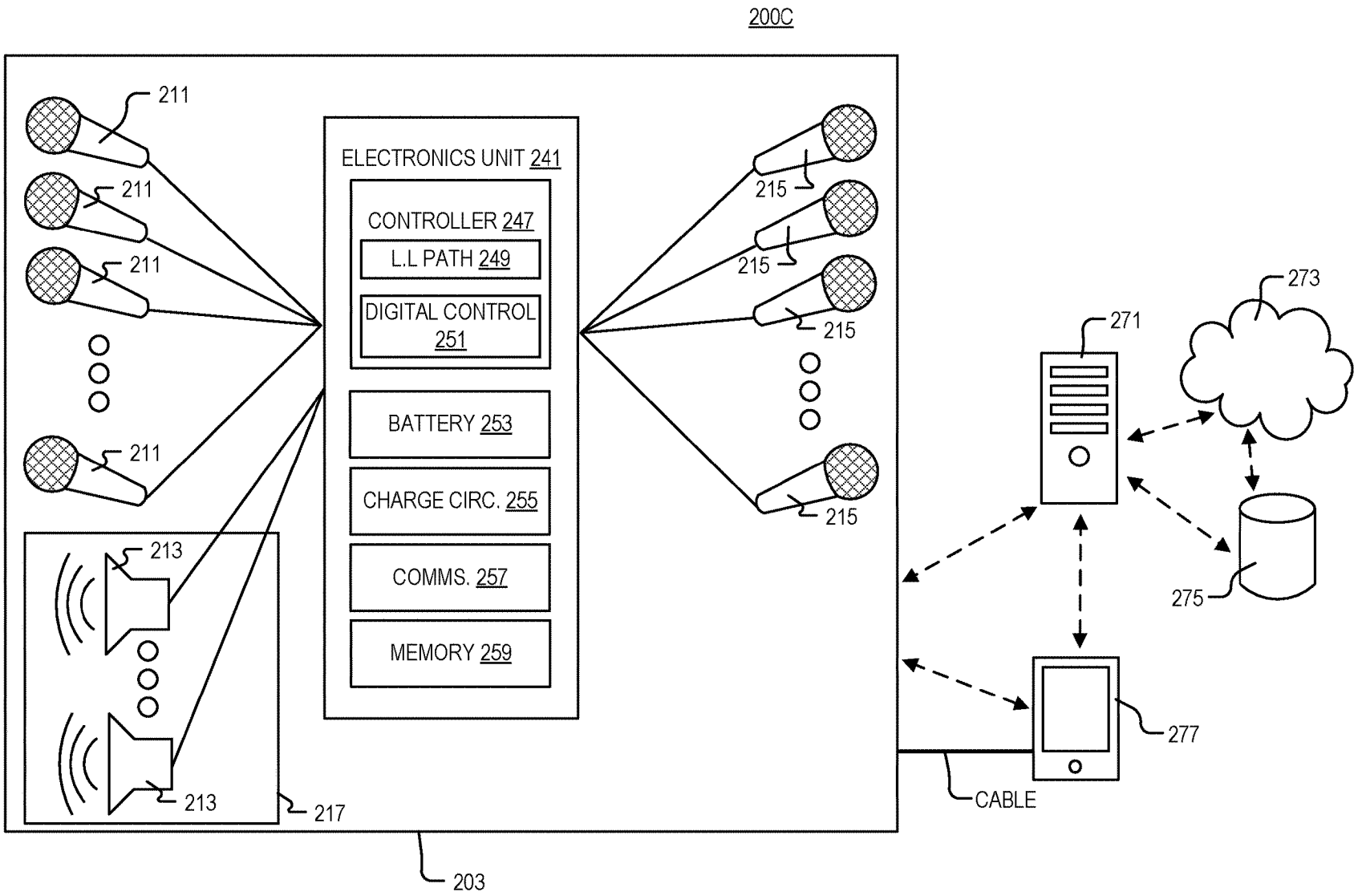
FIG. 2C illustrates a block diagram for a system including the audio device of FIGS. 2A and 2B, in accordance with an embodiment of the disclosure.

FIG. 2C illustrates a block diagram for a system 200C including the in-ear device of FIGS. 2A and 2B, in accordance with an embodiment of the disclosure. As shown the in ear-device in the system 200C includes all the same components as in ear device 200B depicted in FIG. 2B. However, system 200C also includes personal electronic device 277 (e.g., a smartphone, tablet, laptop, personal computer, or the like), one or more servers 271, and storage 275. Servers 271 and storage 275 may all be part of cloud 273.

As shown, communication circuitry 257 may communicate with a smart phone 277 or other portable electronic device, and/or one or more servers 271 and storage 275 which are part of the "cloud" 273. Data may be transmitted to the external devices from in-ear device 200, for example recordings from microphones 211/215 may be sent to smart phone 277 and uploaded to the cloud. Conversely, data may be downloaded from one or more external devices; for example, music may be retrieved from smart phone 277 or directly from a WIFI network (e.g., in the user's house). The smart phone 277 or other remote devices may be used to interact with, and control, in-ear device 200C manually (e.g., through a user interface like an app) or automatically (e.g., automatic data synch). In some embodiments, the one or more external devices depicted may be used to perform calculations that are processor intensive, and send the results back to the in-ear device 200C.

In the depicted embodiment, communications circuitry 257 (e.g., a wireless or wired transceiver), may also communicate with external device(s) (e.g., personal electronic device 277, or directly to a router to connect to servers 271 or the like) to receive an updated control file including second digital control parameters that are different than the digital control parameters. Second digital control parameters may include new or updated control parameters that may better serve the user (e.g., parameters that allow the user to hear better than the original parameters or parameters generated after a software update). Put another way, the user may update control parameters iteratively, or switch control parameters for different users (since each user has a unique HRTF). Updates to the control file may be automatic or the user may tweak their own control file using an app or the like. This may include the user capturing updated pictures of themselves (see e.g., FIG. 3) or tuning (e.g., with virtual "nobs" their own personal preferences).

Figure 3:
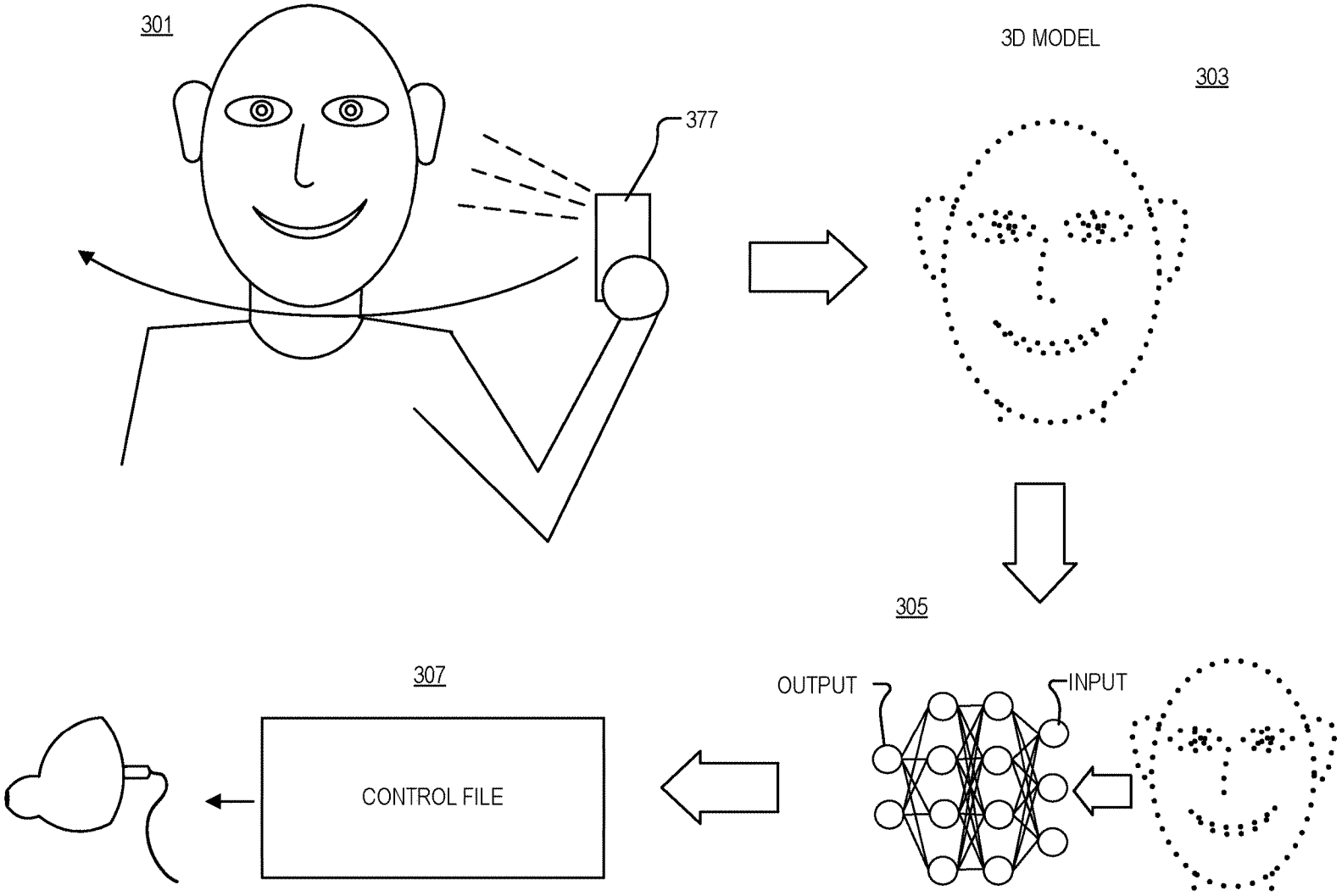
FIG. 3 illustrates part of a method for programming the audio device of FIG. 2A, in accordance with an embodiment of the disclosure.

FIG. 3 illustrates a pictographic depiction of part of a method for programming the in-ear audio device of FIG. 2A, in accordance with an embodiment of the disclosure. One of ordinary skill in the art will appreciate that the processes depicted in the images shown may occur in any order and even in parallel. Additionally, processes may be added to, or removed from, the method, in accordance with the teachings of the present disclosure.

Image 301 shows the user taking an image of their head area. In the depicted embodiment this includes the user taking a panoramic-type photo (e.g., swiping the camera to the left as it captures many images of the user) with their personal electronic device (e.g., a smartphone, tablet, or the like). In some embodiments, this photo may include only 2D image data; however, in other embodiments the camera in the personal electronic device may be able to capture 3D image data (e.g., 2D image data plus depth data). In some embodiments, more complex methods of capturing an image of the user may be used (e.g., 2D imaging in conjunction with LIDAR or the like). The user may then be able to upload this image to the cloud with, for example, a "Custom Headphones" application or the like running on their phone.

Image 303 shows the cloud (e.g., one or more remote servers or processing apparatuses) receiving image data—which includes data describing at least part of a user's head (e.g., head size, head shape, ear shape, or ear location)—from the personal electronic device via a network (e.g., the internet or local area network). The image is then converted into a model of at least part of the user's head. Here, the model is a 3D point cloud, which may be derived from a 2D image (e.g., using triangulation, artificial intelligence techniques, or the like). 3D image data (e.g., from 3D cameras) may also be used to create a model with less processing. One of skill in the art will appreciate that the model described here can be any data derived from the image data.

Image 305 shows generating, using a processing apparatus, a control file corresponding to the model, where the digital control parameters in the file are derived from the model of the user's anatomy. The control file includes digital control parameters with weights to bias low-latency circuits in the low-latency audio processing path, and the low-latency audio processing path is included in a controller of the audio device. In the depicted embodiment generating the control file includes using a deep neural network machine learning algorithm to generate the digital control parameters, and the model is included in the inputs to the algorithm and the digital control parameters are included in the outputs of the algorithm. Thus, the machine learning algorithm receives the model of the user's anatomy, and outputs the digital control parameters for the control file.

In some embodiments, the machine learning algorithm that outputs the digital control parameters may be trained using a plurality of head models (e.g., 3D point cloud data of anonymized heads) and ground-truth digital control parameters (e.g., the control parameters for the 3D point cloud head model data that produced the best sound). This training data may be created both by measuring actual people and inputting their metrics into a database (all actions performed with informed consent only), and by generating simulated data (e.g., using several measurements of head data and interpolating or extrapolating other head data metrics). For example, a person with a very large head could be measured, and a person with a very small head could be measured. This information may be used to interpolate ground-truth data for someone with a medium-sized head. It is appreciated that the plurality of head models and ground-truth digital control parameters may be located in a database coupled to communicate with the processing apparatus (e.g., one or more servers, a general purpose processor, graphics cards running the machine learning algorithms, or the like) to train the machine learning algorithm. In some embodiments, as more head scans are uploaded, the machine learning algorithm may further improve its accuracy to output digital control parameters that correspond to individual users.

Image 307 shows sending a control file, including the digital control parameters generated by the machine learning algorithm, to an in ear device. It is appreciated that the file may pass through other intermediate devices before reaching the controller in the in-ear device.

Figure 4:
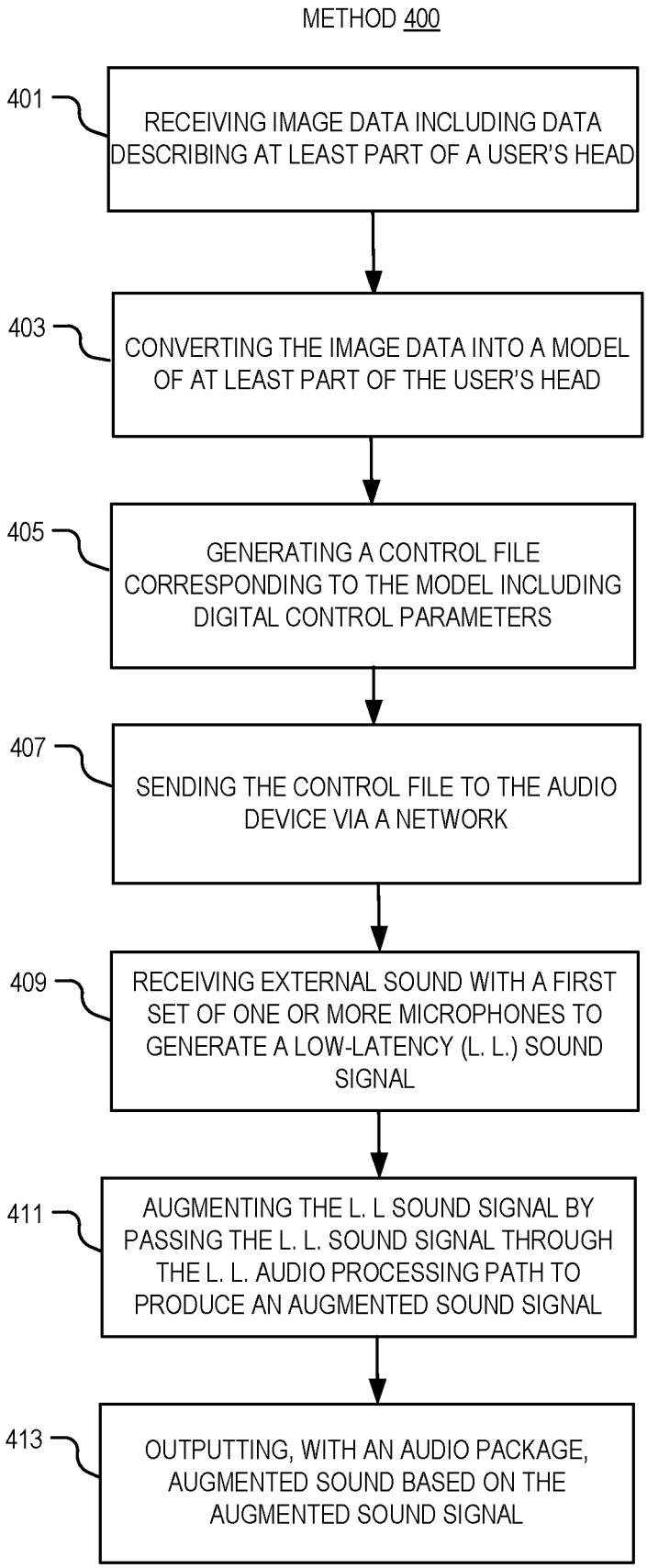
FIG. 4 illustrates part of method for programming and using the audio device of FIG. 2A, in accordance with an embodiment of the disclosure.

FIG. 4 illustrates part of method for programming and using the in-ear audio device of FIG. 2A, in accordance with an embodiment of the disclosure. One of ordinary skill in the art will appreciate that blocks 401-413 depicted in method 400 may occur in any order and even in parallel. Additionally, blocks may be added to, or removed from, the method, in accordance with the teachings of the present disclosure.

Blocks 401-407 illustrate programming the audio device. Block 401 shows receiving image data including data describing at least part of a user's head. As described above, image data may be received from a camera disposed in a personal electronic device via a network, or from other devices.

Block 403 depicts converting the image data into a model of at least part of the user's head. In one embodiment, converting the image data into a model includes converting the image data into a three-dimensional point cloud.

Block 405 illustrates generating, using a processing apparatus, a control file corresponding to the model. As stated, the control file includes digital control parameters that bias low-latency circuits (e.g., by increasing or decreasing gain, etc.), in a low-latency audio processing path in a controller of the audio device. In some embodiments, generating the control file includes using an algorithm to generate the digital control parameters, and the model of the user's head is included in the inputs to the algorithm and the digital control parameters are included in the outputs of the algorithm. In one embodiment, the algorithm includes a deep neural network machine learning algorithm. However, in other embodiments the algorithm finds (e.g., using a root-mean squared similarity method of the like) a head model in a database similar to the model of the user, and outputs the corresponding digital control parameters.

Block 407 shows sending the control file to the audio device via a network. This may include sending the control file to a smartphone over a wireless network and through a headphone cable to the in-ear devices. Alternatively, the in-ear devices may revive the control file directly over the internet through a wireless connection or the like.

Blocks 409-413 illustrate operating the device after the control file has been received. Block 409 depicts receiving external sound with a first set of one or more microphones to generate a low-latency sound signal, where the one or more microphones are coupled to the controller. This may occur after an initial install of the control file, or after an updated control file has been received.

Block 411 illustrates augmenting the low-latency sound signal by passing the low-latency sound signal through the low-latency audio processing path in the controller to produce an augmented sound signal. Digital control parameters include weights to bias the low-latency circuits in the low-latency audio processing path (e.g., by adjusting resistances in filters, controlling the gain in an amplifier, or the like) thereby augmenting the low-latency sound signal as it is passed through the low-latency audio processing path in a manner personalized or customized for the individual user.

Block 413 shows outputting, with an audio package, augmented sound based on the augmented sound signal. Using the techniques presented herein, in some embodiments, the augmented sound may provide at least partial sound transparency to the user. Other embodiments may provide for noise cancellation or reduction of the augmented sound signal.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An in-ear device, comprising:

a housing shaped to fit in and hold to an ear of a user;

an audio package including a plurality of audio outputs, disposed in the housing, to emit an augmented sound;

a first set of microphones disposed within the housing and positioned to face away from the ear and receive first external sounds;

a second set of microphones disposed within the housing and positioned to face into the ear of the user and receive second external sounds incident on the in-ear device from an inside of a head of the user; and a controller disposed within the housing and coupled to the audio package and the first and second set of microphones, the controller including a low-latency audio processing path and digital control parameters, wherein the controller includes a logic that when executed by the controller causes the in-ear device to perform operations, including:

receiving the first and second external sounds with the first and second set of microphones to generate a low-latency sound signal based upon a combination of the first and second external sounds;

augmenting the low-latency sound signal by passing the low-latency sound signal through the low-latency audio processing path to produce an augmented sound signal, wherein the digital control parameters include weights to bias circuits in the low-latency audio processing path, and wherein the digital control parameters are derived from a model of the user's anatomy; and outputting, with the audio package, the augmented sound based on the augmented sound signal.

2. The in-ear device of claim 1, wherein the low-latency audio processing path includes at least one of analog circuitry, a digital signal processor, application specific integrated circuitry, or a field programmable gate array.

3. The in-ear device of claim 1, wherein the user's anatomy includes at least one of a head size, a head shape, an ear shape, or an ear location.

4. The in-ear device of claim 1, wherein the digital control parameters are included in a control file.

5. The in-ear device of claim 4, wherein the digital control parameters are generated using a machine learning algorithm that receives the model of the user's anatomy and outputs the digital control parameters for the control file.

6. The in-ear device of claim 5, further comprising communications circuitry, wherein the controller includes a further logic that when executed by the controller causes the in-ear device to perform further operations, including:

communicating, using the communications circuitry, with an external device to receive an updated control file including second digital control parameters that are different than the digital control parameters.

7. The in-ear device of claim 6, wherein the communications circuitry includes a wireless transceiver to communicate with the external device.

8. The in-ear device of claim 1, wherein the housing at least partially occludes a canal of the ear, and wherein the augmented sound provides at least partial sound transparency to the user.

9. The in-ear device of claim 1, wherein the digital control parameters are stored in a memory in the controller.

10. The in-ear device of claim 1, wherein the augmented sound provides at least partial sound transparency to the user.

11. The in-ear device of claim 1, wherein the low-latency audio processing path is configured to map a plurality of microphone inputs to one or more audio outputs, wherein there are more of the microphone inputs than the audio outputs.

12. The in-ear device of claim 1, wherein the circuits of the low-latency audio processing path comprise analog circuits of the in-ear device and the digital control parameters are programmable values for biasing the analog circuits, wherein the programmable values are derived from images of the user's anatomy.

13. The in-ear device of claim 1, wherein a first number of microphone inputs in the first set of microphones exceeds a second number of the audio outputs in the audio package.

14. The in-ear device of claim 13, wherein the digital control parameters further operate to program a mapping between the microphone inputs and the audio outputs.

* * * * *